US006092574A

United States Patent [19]

Krulik

[11] Patent Number: 6,092,574

[45] Date of Patent: Jul. 25, 2000

[54] CARRYING CASES WITH STRAIN RELIEF SHOULDER ATTACHMENTS

[75] Inventor: Richard J. Krulik, Dix Hills, N.Y.

[73] Assignee: United States Luggage, L.P., Hauppauge, N.Y.

[21] Appl. No.: 09/289,204

[22] Filed: Apr. 9, 1999

[51] Int. Cl.[7] ..... G45C 13/26

[52] U.S. Cl. ..... 150/110; 190/116; 383/13; 224/254; 224/616

[58] Field of Search ..... 383/13, 17; 224/257, 224/258, 264, 607, 613, 614, 616, 617, 619; 150/107, 108, 109, 110; 190/115, 116

[56] References Cited

U.S. PATENT DOCUMENTS

| | | | |
|---|---|---|---|
| 1,865,353 | 6/1932 | Brewster . | |
| 1,979,978 | 11/1934 | Martin | 383/17 X |
| 2,089,402 | 8/1937 | Murray . | |
| 2,705,987 | 4/1955 | Schulte | 383/13 X |
| 3,326,257 | 6/1967 | Gordon | 150/110 |
| 3,995,802 | 12/1976 | Johnston | 190/115 X |
| 4,088,167 | 5/1978 | Schwartz | 150/107 |
| 4,088,251 | 5/1978 | Rodriguez | 224/626 |
| 4,530,168 | 7/1985 | Petre . | |
| 4,793,533 | 12/1988 | Yang | 224/148.2 |
| 4,852,782 | 8/1989 | Wu et al. | 206/315.2 X |
| 5,411,194 | 5/1995 | Nagasawa et al. | 224/257 X |
| 5,450,995 | 9/1995 | Perrin . | |
| 5,544,795 | 8/1996 | Perrin . | |
| 5,695,102 | 12/1997 | Jackson . | |
| 5,735,398 | 4/1998 | Price | 224/613 |
| 5,884,827 | 3/1999 | Stein | 224/257 X |
| 5,915,608 | 6/1999 | Mao | 224/616 X |

*Primary Examiner*—Stephen P. Garbe
*Assistant Examiner*—Tri M. Mai
*Attorney, Agent, or Firm*—Abelman, Frayne & Schwab

[57] ABSTRACT

An article of luggage is provided with a removable wrap, such as a shoulder strap, in which strain relief is provided between the carrying strap and the article of luggage. The strain relief is provided by a strain relief member, typically elastic material, within the connection member that is permanently secured to the article of luggage and is intended to be manually connected to the removable carrying strap.

20 Claims, 2 Drawing Sheets

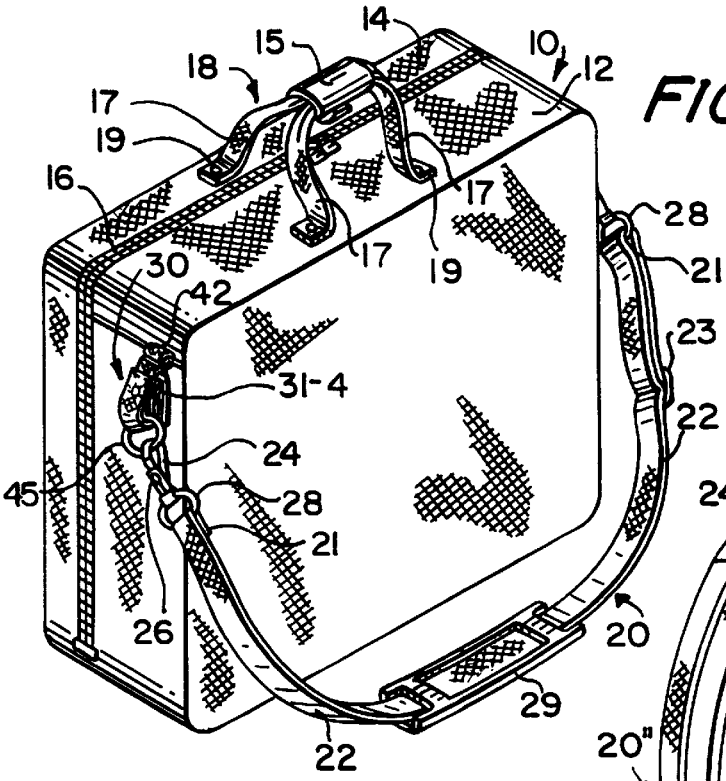
FIG. 1
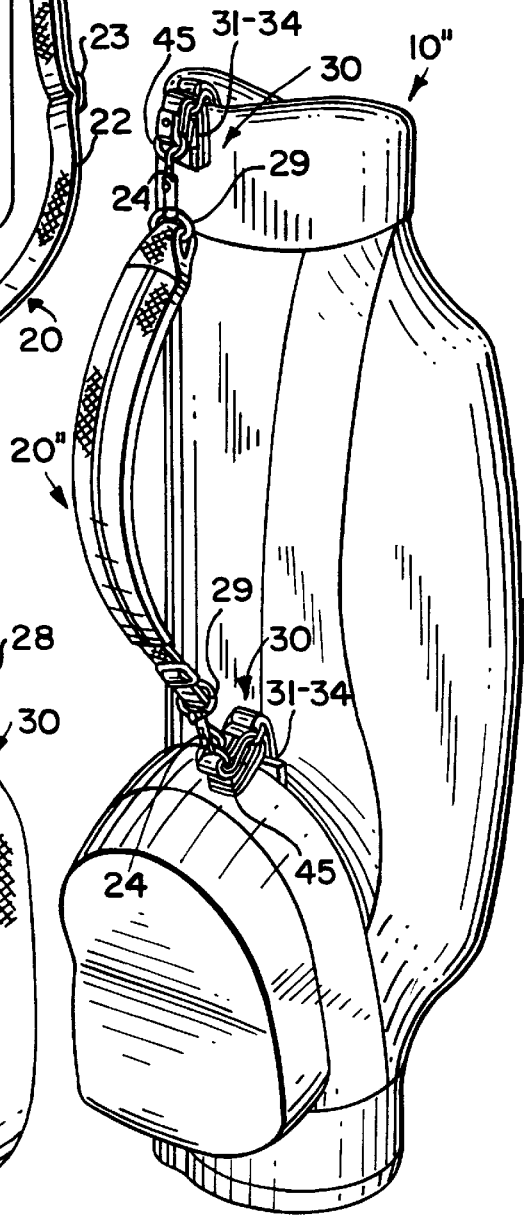
FIG. 3
FIG. 2
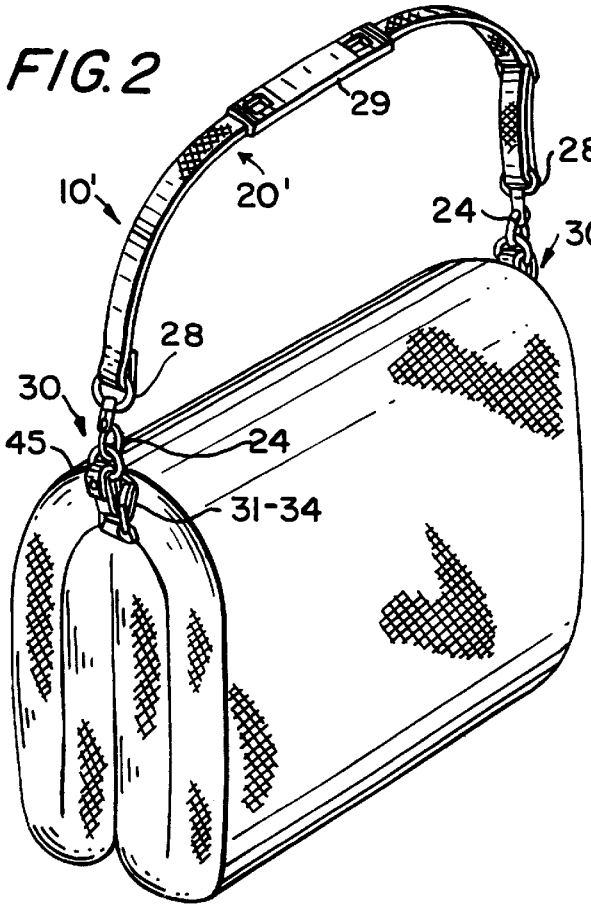

CARRYING CASES WITH STRAIN RELIEF SHOULDER ATTACHMENTS

FIELD OF INVENTION

A carrying case is provided with a removable strap, such as a member, in conjunction with the connection of the carrying strap to the article of luggage.

BACKGROUND OF THE INVENTION

Various types of articles of luggage, such as totes, garment bags, golf bags, and back packs are provided with removable straps to facilitate the user's carrying of the article of luggage. Such straps, which quite often extend over the shoulders of the user, will, on many occasions, be carrying a substantial weight. In order to minimize the strain of the bag on the user's shoulder, particularly when the bag may be bouncing as the user is walking, it is well known to provide a shock absorbing strain relief member, typically a length of elastic, in conjunction with the strap. Such a strain relief member has, in the past, been integrated within the shoulder strap structure. Such shoulder straps are generally removable, and could, over a period of time, become lost or worn, requiring the user to obtain a replacement shoulder strap. In such prior constructions, the replacement shoulder strap must naturally have the strain relief included therein, in order to still provide the requisite strain relief and associated comfort to the user. This naturally increases the cost of such replacement shoulder straps.

Another disadvantage of such prior constructions, where the strain relief is provided within the shoulder strap, results in the manner that such articles of luggage are sold to the consuming public. In many instances the removable shoulder strap is placed within the article of luggage, for subsequent securement after the user purchases the luggage. Thus, it will not be apparent to the potential consumer who observes the article of luggage without the removable shoulder strap, that the shoulder strap includes desirable strain relief. The present invention not only simplifies and reduces the cost of replacing the shoulder strap, but makes it readily apparent at the point-of-sale, that the article of luggage does include strain relief in conjunction with its shoulder strap securement. Further, it facilitates the substitution of different lengths of carrying straps while advantageously maintaining strain relief.

SUMMARY OF THE INVENTION

In accordance with the present invention the carrying strap, which may typically be a shoulder strap, is constructed of substantially non-stretchable material. The strain relief between the shoulder strap and article of luggage provided within the connection means carried by the article of luggage which is to be connected to the removable shoulder strap. More specifically, the shoulder strap, which is formed of substantially non-stretchable material, will include a manually operable strap connector at each of its free ends. The strap connector, which may be in the form of a normally closed spring biased hook like element, includes a manually engageable portion for opening the hook in opposition to its spring biasing. The article of luggage will include a pair of spaced connection means at strap securement locations which are positioned to receive the strap connectors when it is desired to secure the shoulder strap to the article of luggage. The connection means which is permanently secured to the article of luggage, advantageously, in accordance with the present invention, includes the strain relief member integrated therein. In accordance with the preferred embodiment of the present invention, the connection member which is connected to the article of luggage has a closed ring at its free end to receive the shoulder strap. Elastic is interposed between the closed ring and its securement to the article of luggage. Preferably the elastic may be comprised of a plurality of superimposed layers of lengths of elastic. This advantageously increases the modulas of elasticity to enhance the amount of strain relief provided within the connector. The elastic strain relief member which is within the shoulder strap connectors on the article of luggage will therefore be readily apparent at the point-of-sale, thereby immediately advising the potential consumer of the advantageous feature provided by the present invention.

When it is desired to connect the shoulder strap to the article of luggage, the spring biased hook like elements at the ends of the shoulder straps are manually opened and slipped over the closed rings carried by the article of luggage. They are then released so as to provide a secure engagement between the ends of the shoulder strap and the rings secured to the article of luggage. The interposition of the elastic material between the ring, and the securement of its connection member to the article of luggage, will always provide strain relief, should the user wish to substitute a different carrying strap which is devoid of elastic or another strain relief construction. It should naturally be understood that other forms of connector constructions between the ends of the carrying strap and the article of luggage may be utilized in accordance with the present invention, it only being required that the strain relief be within the connector that is permanently secured to the article of luggage. Further, while the present invention is shown by way of example, in conjunction with tote, garment, and golf bags, it may be used in conjunction with other articles of luggage having removable straps, such as back packs.

It is therefore a primary object of the present invention to provide a manually transportable article of luggage having a removable carrying strap, in which strain relief in conjunction with the carrying strap is provided by the strap receiving connection which is permanently secured to the article of luggage.

A further object of the present invention is to provide the strain relief by elastic material which is interposed between the permanent securement of the strap receiving connector to the article of luggage, and its free end which receives the strap.

Another object of the present invention is to provide such a manually transportable article of luggage where the strain relief is provided by a plurality of superimposed layers of elastic to provide a high modulas stretchable connection between the free ends of the connection and its securement to the article of luggage.

These as well as other objects of the present invention will become apparent upon a description of the following drawings:

BRIEF DESCRIPTION OF THE DRAWINGS

FIG. 1 is a perspective view showing the present invention incorporated within a tote bag.

FIG. 2 is a perspective view showing the present invention incorporated within a garment bag.

FIG. 3 is a perspective view showing the present invention incorporated within a golf bag.

DETAILED DESCRIPTION OF THE PREFERRED EMBODIMENTS

Figure 4:
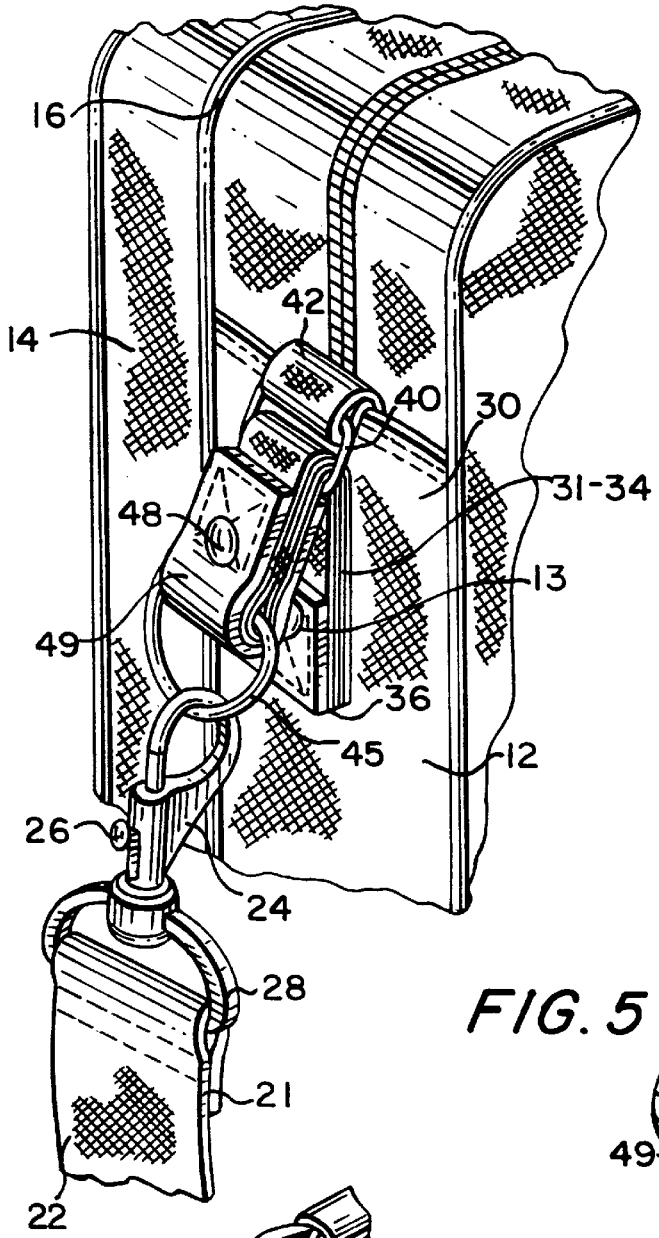
FIG. 4 is a detail of the connection of FIG. 1 between one end of the removable shoulder strap and the permanent connection member secured to the tote bag.
Figure 5:
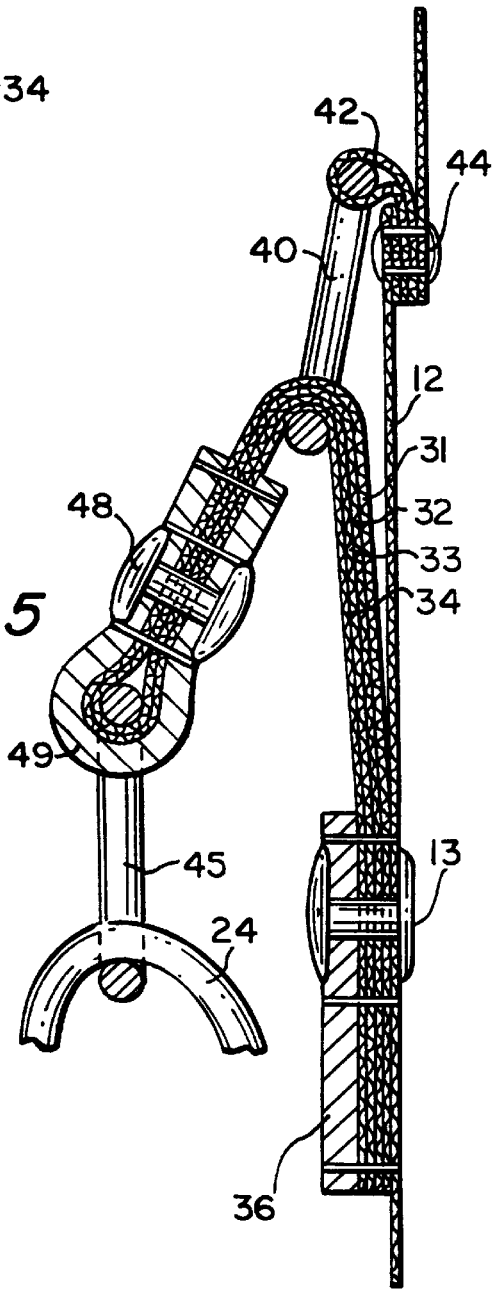
FIG. 5 is a cross sectional view of the connection shown in FIG. 4, to reveal further details thereof.

Referring initially to FIGS. 1, 4, and 5 the tote bag 10 which may typically be constructed of canvas, leather, vinyl, or other well known materials includes a housing base 12 and hingeable cover 14 enclosed by a zipper 16 in the well known manner. A hand strap assembly 18 is provided which includes individual strap sections 17, which may be secured to the case by rivets 19, and a hand engageable member 15 which envelopes the free ends of the strap 17 when the case is in the closed condition as shown in FIG. 1.

In many instances it may be desired to carry the bag 10 over the user's shoulder, in which case a removable shoulder strap assembly 20 is provided. Shoulder strap assembly 20, in accordance with the present invention, is formed of substantially non stretch material, and may include woven fabric straps 22, whose overall length may be adjusted by buckle 23 to accommodate the requirements of the particular user. Strap assembly 20 is preferably removable so that the consumer need not have strap assembly 20 extending therefrom when it is desired to use case 10 in the hand carrying mode. In that situation the strap assembly 20 would typically be stored within the tote 10. In order to readily permit the removing and reattachment of shoulder strap 20 its free ends each include a manually operable connection member which, in the preferred embodiment shown, includes a spring biased hook like "dog leash" element 24 having a button projection 26 for the manual opening thereof. Upon the release of button 26 hook like element 24 will automatically return to the closed condition shown in FIG. 1 under the force of its biasing spring (not shown). Element 24 may typically be connected to the end 21 of strap 22 but with a D-type closed ring 28 which passes through the looped end 21 of the shoulder strap 20. The shoulder strap will also preferably include a cushioned member 29 for increased comfort when it is resting on the user's shoulder.

To connect the shoulder strap assembly 20 to the tote 10 a cooperating pair of connection members 30 are permanently secured to housing tote section 12, as by rivet 13. In accordance with the present invention, the connection member 30 includes an elastic section, which may preferably be provided by a plurality of superimposed layers of elastic 31, 32, 33, and 34, with a plurality of such individual layers serving to increase the modulas of elasticity, and hence enhance strain relief. Although four such layers are shown, it should naturally be understood that an alternative number of layers could be employed in accordance with the requirements of the particular application. Further, all such layers may be formed of a single piece of elastic material which is appropriately looped at its opposed ends. A reinforcement member 36 which may be formed of leather is interposed between the rivet 13 and its securement of layers 31–34 to the housing 12. Advantageously, in accordance with the preferred embodiment, in this invention the elastic members 31–34 are retained close to the profile of the tote case by passing through on auxiliary ring member 40 which is secured to a vertically displaced area of the housing by a looped member 42, which may typically be formed of fabric and is connected to housing by a rivet 44. A closed D ring 45 is connected to the free end of the connection member 30 for the reception of the hook like element 24 at the end of the shoulder strap when it is desired to connect the shoulder strap assembly 20 to the tote bag 10. The closed ring 45 is shown connected to the free end of the elastic strain relief member (which is preferably provided by superimposed layers 31–34) by a rivet 48 and reinforcing element 49, which may typically be formed of leather.

Thus, according to the present invention, the strain relief provided by the connection of the shoulder strap assembly 20 to the tote bag is provided by the elastic relief member 31–34. Accordingly, should the shoulder strap 20 be removed and placed within the tote 10, as typically occurs at the point-of-sale, the presence of strain relief will still be readily apparent to the potential consumer by virtue of the visual prominence of elastic layers 31–34 in the permanent securement of the strap connection assembly 30. Further, should it be desirable to replace strap assembly 20 with an alternative strap assembly, in the event strap assembly 20 becomes lost or worn, the replacement strap assembly can likewise be formed of substantially non stretch material, since the strain relief will still be provided by the permanent securement of connection members 30 to the article of luggage.

Reference is now made to FIGS. 2 and 3 which show the present invention being incorporated, respectively, within a garment carrying case 10' and golf bag 10" and in which those components corresponding to the above-discussed FIGS. 1, 4, and 5 are similarly numbered. It should be noted that the connection members 30 secured to the garment bag 10' and golf bag 10" correspond to that shown in conjunction with the tote bag 10. However, should a lesser or greater amount of strain relief be required, the elastic material, shown as superimposed layers 31–34 may be appropriately modified in accordance with the requirements of that particular article of luggage. Similarly, the shoulder straps 20' and 20" will be configured in accordance with the requirements of that particular article of luggage. However the connection member at its free ends may correspond to that showing in the prior embodiment, including spring biased hook like element 24 which engages closed ring 45 permanently secured to the article of luggage.

Figure 6:
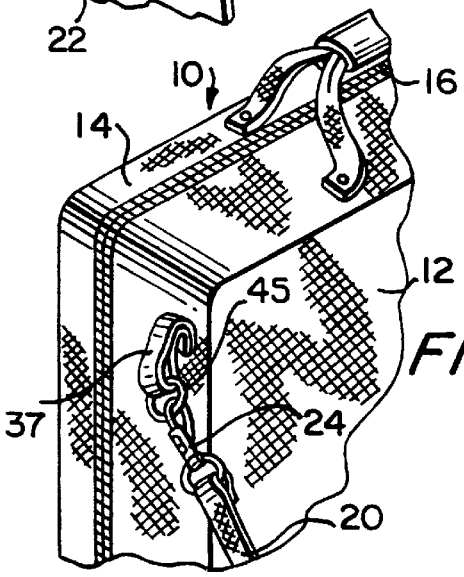
FIG. 6 is a partial perspective view of an alternative embodiment of the present invention in conjunction with a tote bag.

Reference is now made to FIG. 6 which shows a modified form of the present invention in conjunction with tote 10. The shoulder strap 20 may correspond to that shown in the embodiment of FIGS. 1, 4, and 5, and include the manually operable connection means, including a hook like element 24 at its free ends, which is intended to engage closed rings 45 carried by the tote 10. In this particular embodiment, where a lesser degree of strain relief may be required, the connection of ring 45 to the tote 10 may be simplified by comprising only a single loop of elastic 37 which is secured to the tote bag 10 by either sewing or a rivet (not shown).

Although the present invention has been described in conjunction with preferred embodiments, it should naturally be understood that various modifications may be made thereto. In addition to being incorporated within a tote bag, garment bag, or golf bag, for example, the construction of the present invention may be used in various other articles of luggage, such as back packs. Accordingly, it is intended that the invention be defined by the scope of the following claims:

I claim:

1. A manually transportable article of luggage comprising:

a housing for establishing an article receiving enclosure and a carrying strap that is manually removable and replaceable without damage for connection to said housing;

at least one pair of connection means for the manually replaceable securement of said removable carrying strap to said housing;

said connection means including interengageable first and second connection members, said first member secured to a strap securement location of said housing and said second member secured to a free end of said removable carrying strap;

a stretchable strain relief member extending outward of and permanently secured to said housing at said strap securement location and positioned intermediate said housing and said first connection member;

said removable carrying strap being formed of substantially non stretchable material, such that the stretchable strain relief between said removable shoulder strap and housing is provided by said stretchable strain relief member.

2. A manually transportable article of luggage according to claim 1, wherein said stretchable strain relief member includes elastic material.

3. A manually transportable article of luggage according to claim 1, wherein said removable carrying strap is a shoulder strap.

4. A manually transportable article of luggage according to claim 1, wherein said first connection member includes a closed ring and said second member includes a normally closed spring biased element with a manually engageable portion for opening said element in opposition to its spring biasing, the opening of said element allowing the entry of said element into said ring for the interengagement of said first and second connection members, said interengagement connecting said removable carrying strap to said housing with the subsequent spring biased closing of said element maintaining engagement of said first and second connection members, and the subsequent manual opening of said element allowing disengagement of said first and second connection members for disconnecting said removable carrying strap from said housing.

5. A manually transportable article of luggage according to claim 4, wherein said stretchable strain relief member includes elastic material intermediate said closed ring and the securement of said first connection member to said housing.

6. A manually transportable article of luggage according to claim 5, wherein said elastic material comprises a plurality of superimposed layers of elastic.

7. A manually transportable article of luggage according to claim 6, wherein said superimposed layers of elastic are formed of a single piece of elastic looped at its opposed ends.

8. A manually transportable article of luggage according to claim 5, wherein said removable carrying strap is a shoulder strap.

9. A manually transportable article of luggage according to claim 8, wherein said article of luggage is a tote bag.

10. A manually transportable article of luggage according to claim 8, wherein said article of luggage is a garment bag.

11. A manually transportable article of luggage according to claim 8, wherein said article of luggage is a golf bag.

12. A manually transportable article of luggage comprising: a housing for establishing an article receiving enclosure;

a shoulder strap for manual removable and replaceable securement to said housing without damage to said shoulder strap;

said shoulder strap formed of substantially non-stretchable material and including a manually operable strap connector at each of its fill ends;

said housing including a pair of spaced connection means at strap securement locations, each adapted to receive one of said shoulder strap connectors for the securement of said shoulder strap to said housing;

each of said connection means including a strap receiving connector; and at least one of said connection means including a stretchable strain relief member, said stretchable strain relief member including first and second ends, said first end permanently secured to said housing at its strap securement location, and said second end extending outward of said housing and secured to said strap receiving connector, such that the stretchable strain relief between said housing and said removable shoulder strap is provided by said stretchable strain relief member and said stretchable strain relief member is externally present on said housing.

13. A manually transportable article of luggage according to claim 12, wherein said stretchable strain relief member includes elastic material.

14. A manually transportable article of luggage according to claim 13, wherein said elastic material comprises a plurality of superimposed layers of elastic.

15. A manually transportable article of luggage according to claim 14, wherein said superimposed layers of elastic are formed of a single piece of elastic looped at its opposed ends.

16. A manually transportable article of luggage according to claim 13, wherein each of said pair of spaced connection means includes said elastic strain relief member.

17. A manually transportable article of luggage according to claim 12, wherein said strap receiving connector is a closed ring and said strap connector member is a normally closed spring biased element with a manually engageable portion for opening said element in opposition to its spring biasing, the opening of said element allowing the entry of said element into said ring for the interengagement of said strap connector and strap receiving connector, said interengagement connecting said shoulder strap to said housing with the subsequent spring biased closing of said element maintaining engagement of said strap connector and strap receiving connector, and the subsequent manual opening of said element allowing disengagement of said strap connector and strap receiving connector for disconnecting said shoulder strap from said housing.

18. A manually transportable article of luggage according to claim 17, wherein said article of luggage is a golf bag.

19. A manually transportable article of luggage according to claim 17, wherein said article of luggage is a tote bag.

20. A manually transportable article of luggage according to claim 17, wherein said article of luggage is a garment bag.

* * * * *